US005561501A

United States Patent [19]

Honma

[11] Patent Number: 5,561,501

[45] Date of Patent: Oct. 1, 1996

[54] ADMINISTRATING APPARATUS FOR ADMINISTRATING A STATUS OF AN IMAGE FORMING APPARATUS

[75] Inventor: Masayuki Honma, Tokyo, Japan

[73] Assignee: Canon Kabushiki Kaisha, Tokyo, Japan

[21] Appl. No.: 363,032

[22] Filed: Dec. 23, 1994

[30] Foreign Application Priority Data

Dec. 28, 1993 [JP] Japan ..... 5-338184

[51] Int. Cl.[6] ..... G03G 15/00

[52] U.S. Cl. ..... 355/204; 355/308; 355/311; 377/15

[58] Field of Search ..... 355/201, 202, 355/204, 308, 311, 209; 377/8, 13, 15, 16

[56] References Cited

U.S. PATENT DOCUMENTS 5,077,582 12/1991 Kravette et al. ..... 355/209 X
5,117,258 5/1992 Iwata ..... 355/201

FOREIGN PATENT DOCUMENTS 2-108071 4/1990 Japan ..... 355/308

*Primary Examiner*—Joan H. Pendegrass
*Attorney, Agent, or Firm*—Fitzpatrick, Cella, Harper & Scinto

[57] ABSTRACT

An administrating apparatus for administrating an image forming apparatus comprises a first receiving unit for receiving the status information of the image forming apparatus in the serial communication, a second receiving unit for receiving a pulse signal in accordance with the operation of the image forming apparatus, and a count unit for counting for each status indicated by the status information received in accordance with the pulse signal received. The administrating apparatus for administrating the image forming apparatus for each status can be provided with a simple construction.

20 Claims, 6 Drawing Sheets

ADMINISTRATING APPARATUS FOR ADMINISTRATING A STATUS OF AN IMAGE FORMING APPARATUS

BACKGROUND OF THE INVENTION

1. Field of the Invention

The present invention relates to an administrating apparatus for administrating a status of an image forming apparatus.

2. Related Background Art

Conventionally, copy machine administrating apparatuses for counting the copy count pulse which is output from a copying machine and sending its count result as a total copy count number to a host computer have been proposed. The above administration can be effected by connecting via one count pulse signal line and a small number of control signal lines between such a copying machine administrating apparatus and the copying machine.

However, in administrating not only the total copy count number but also the copy number for each copy mode or each size of transfer sheet copied, there is a problem that in addition to a great number of signal lines required, a lot of ports of a CPU for the copying machine may be occupied.

SUMMARY OF THE INVENTION

It is an object of the present invention to provide an administrating apparatus in which the aforementioned problem is resolved.

Also, it is another object of the invention to provide an administrating apparatus with a reduced number of signal lines between an image forming apparatus and the administrating apparatus.

Also, it is a further object of the invention to provide an administrating apparatus for administrating a status of an image forming apparatus with a simple construction.

Other objects and features of the present invention will be more apparent from the following description and the accompanying drawings.

DETAILED DESCRIPTION THE PREFERRED EMBODIMENTS

[First Example]

Figure 1:
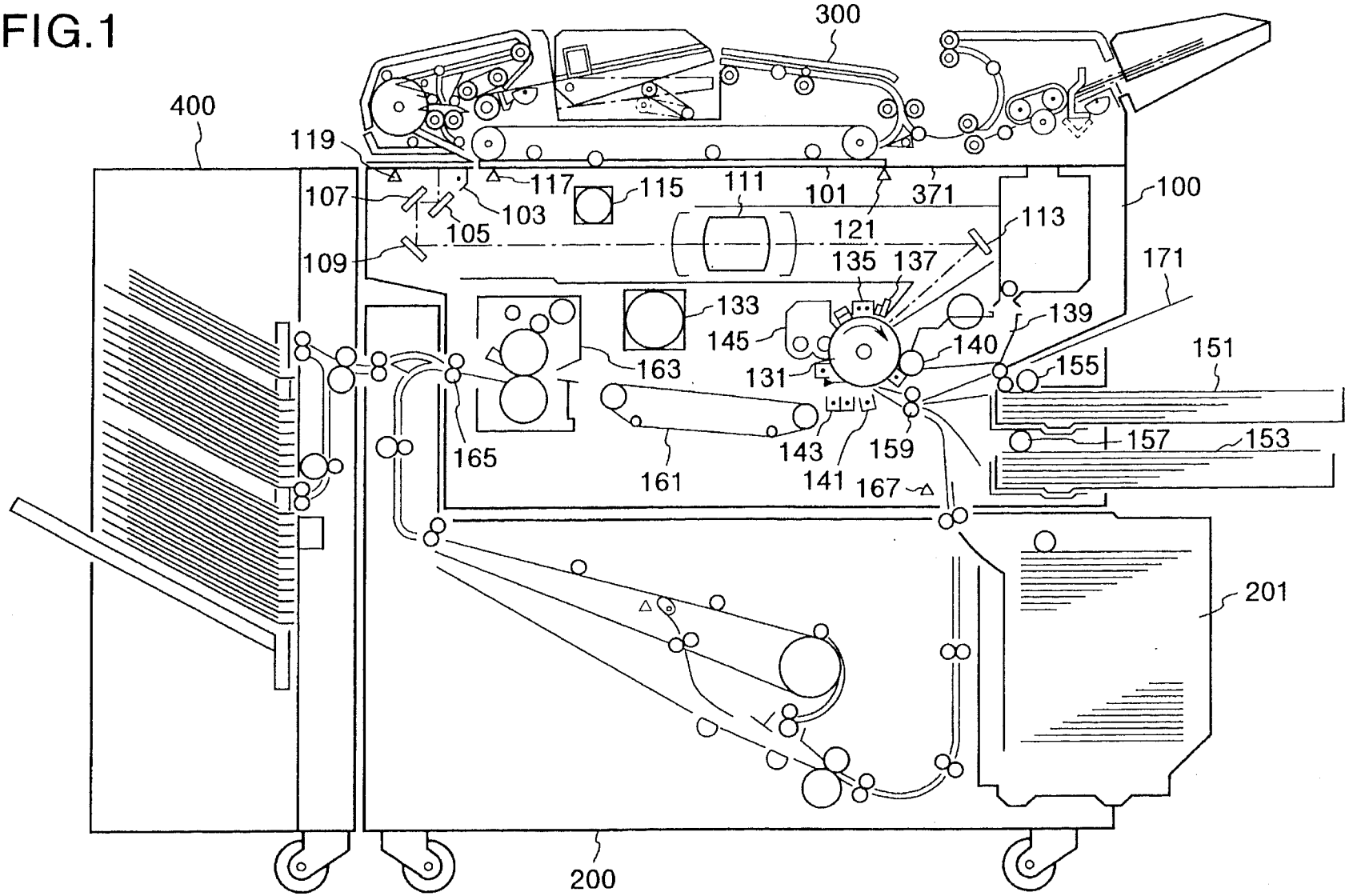
FIG. 1 is a cross-sectional view for explaining the constitution of a copying system in an example of the invention.

FIG. 1 is a cross-sectional view for explaining the constitution of a copying system in an example of the present invention.

In a main body 100, 101 is a platen glass on which originals are laid, 103 is an illuminating lamp (exposure lamp) for illuminating the original, 105, 107, 109 are scanning mirrors (scan mirrors) for directing the reflected light from the original, 111 is a lens for effecting the focusing and the variable power, and 113 is a reflection mirror (scan mirror) for directing the reflected light from the original. Reference numeral 115 is an optical system motor for driving an optical system, and 117, 119, 121 are sensors for sensing the light from the exposure lamp 103. Reference numeral 131 is a photosensitive drum, 133 is a main motor for driving the photosensitive drum 131, 135 is a high voltage unit, 137 is a blank exposure unit, 139 is a developing unit, 140 is a developing roller, 141 is a transfer charging unit, 143 is a separation charging unit, and 145 is a cleaning unit. Reference numeral 151 is an upper-stage cassette, 153 is a lower-stage cassette, 171 is a sheet supply opening with manual insertion, 155 and 157 are sheet supply rollers, and 159 is a registration roller.

Also, 161 is a conveying belt for conveying the recording sheet having the image recorded thereon to a fixing unit 163, 163 is the fixing unit for thermally fixing the recording sheet conveyed thereto, and 167 is a sensor for sensing the sheet which has arrived thereto in recording on both faces of the recording sheet. The surface of the photosensitive drum 131 as mentioned above is composed of a seamless photosensitive member using a photoconductor and an electric conductor, this photosensitive drum 131 being rotatably born around a shaft, and rotated in a direction of the arrow in the figure by a main motor 133 to be activated in response to depressing a copy start key as will be described later.

Then, if the control for predetermined rotation of the photosensitive drum 131 and the potential control process (preprocess) is ended, the original laid on the platen glass 101 is illuminated by the illuminating lamp 103 formed integrally with a first scan mirror 105, the reflected light from the original is directed by the first scan mirror 105, a second scan mirror 107, a third scan mirror 109, the lens 111 and a fourth scan mirror 113, and imaged on the photosensitive drum 131.

The photosensitive drum 131 is corona discharged by the high voltage unit 135. Thereafter, the image (original image) illuminated by the illuminating lamp 103 is exposed through a slit to the light, so that an electrostatic image is formed on the photosensitive drum 131 through a well-known Carlson process. Then, the electrostatic image on the photosensitive drum 131 is developed using a developer to be attached by the developing roller 140 of the developing unit 139, its developer being transferred to the transfer sheet by means of the transfer charging unit 141, as will be described later.

That is, the transfer sheet within the upper-stage cassette 151 or the lower-stage cassette 153, or the transfer sheet set on the manual insertion sheet supply opening 171 is delivered into the main device by the sheet supply roller 155 or 157, and passed toward the photosensitive drum 131 at a correct timing by the registration roller 159 so that the top end of a latent image and the leading end of transfer sheet may coincide.

Thereafter, by the transfer sheet passing between the transfer charging unit 141 and the photosensitive drum 131, the image on the photosensitive drum 131 is transferred onto the transfer sheet. After the end of this transfer, the transfer sheet is separated from the photosensitive drum 131 by the separation charging unit 143, and conveyed on the conveying belt 161 to the fixing unit 163, where it is subjected to the fixing treatment using pressure and heating from the fixing unit 163, and then exhausted out of the main body 100 by means of a sheet exhausting roller 165.

While the photosensitive drum 131 after transfer continues rotating, its surface is being cleaned by the cleaning unit 145 comprised of a cleaning roller and an elastic blade. In FIG. 1, a copying machine administrating apparatus 800 for administrating the copying sheet number for each department, not shown, is packaged on the back face of a copying machine 100.

Also, a cyclic automatic original feeder (RDF) 300 is provided on the upper portion of the copying machine. The RDF 300 is able to sense the size of the original. Reference numeral 200 is an intermediate tray unit having a paper deck 201 which is a sheet feeding unit, and 400 is a sorter.

Figure 2:
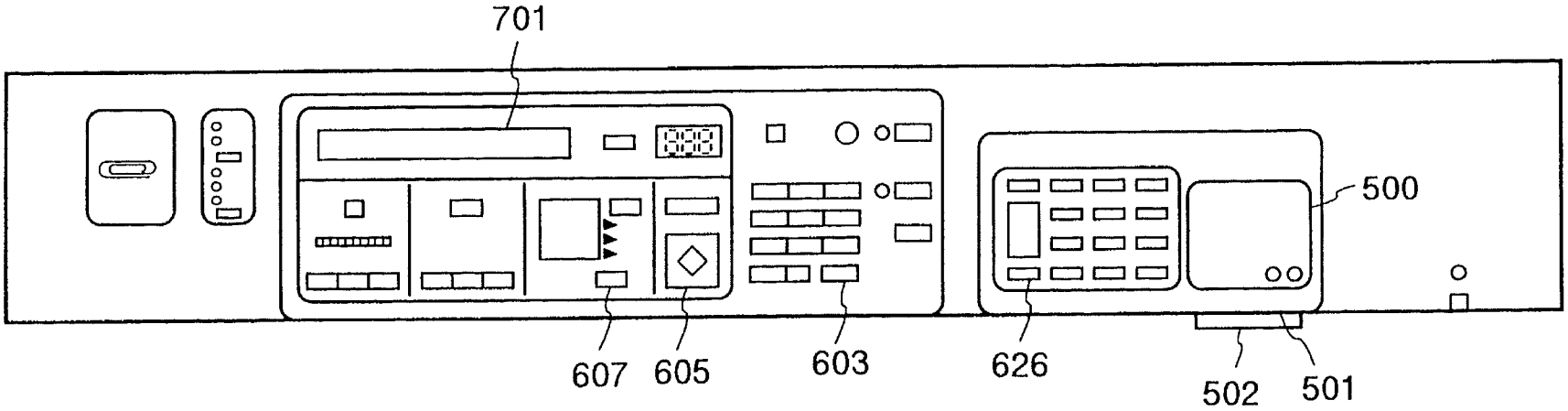
FIG. 2 is a plan view for explaining the arrangement configuration of an operation panel provided on a main body as shown in FIG. 1.

FIG. 2 is a plan view for explaining the arrangement of an operation panel provided on the main body 100 as shown in FIG. 1.

Note that the operation panel is comprised of keys as described below and a display.

Reference numeral 605 is a copy start key which is depressed to start the copy.

Reference numeral 603 is a ten key which is depressed in setting the copy sheet number.

Reference numeral 607 is a cassette selection key which is depressed to select the upper-stage cassette 151, the lower-stage cassette 153 and the lower-stage paper deck 201. Also, when there are originals laid on the RDF 300, an APS (automatic paper selection) can be selected by this key. When the APS is selected, the transfer sheet cassette of the size identical to that of the original is automatically selected.

Reference numeral 626 is a both-side key which is depressed in making the both-side copy from the one-side original, the both-side copy from the both-side original, or the one-side copy from the both-side original.

In FIG. 2, 701 is a message display of LCD (liquid crystal display) type for displaying the copying information, one character being of 5×7 dots, for example, which is able to display a message of up to 40 characters.

When RDF 300 is used in the standard mode, the copy sheet number of 1, the density of AE mode, the automatic sheet selection, direct, and the one-side copy from the one-side original are set. When RDF 300 is not used in the standard mode, the copy sheet number of 1, the density of manual mode, direct, and the one-side copy from the one-side original are set. The use of RDF 300 can be determined depending on whether or not there is any original set on the RDF 300.

Reference numeral 500 is a magnetic card reader connecting to the copying machine administrating apparatus 800. Reference numeral 501 is a card insertion opening which is an inlet opening for inserting a magnetic card 502 such as a department card or an administrator card.

Figure 3:
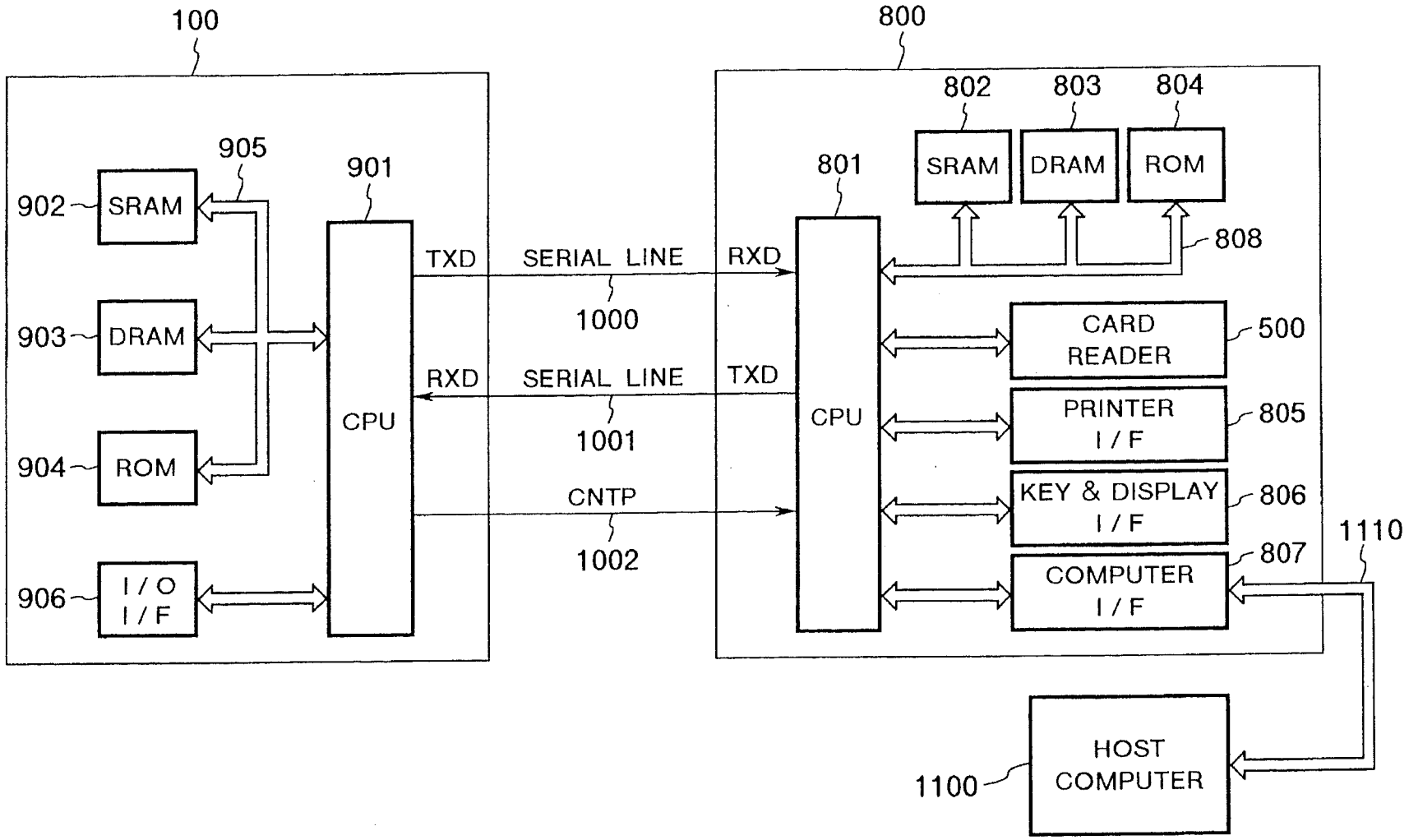
FIG. 3 is a block diagram for explaining the control configuration for a copying machine and a copying machine administrating apparatus as shown in FIG. 1.

FIG. 3 is a block diagram for explaining the control configuration for the copying machine 100 and the copying machine administrating apparatus 800 as shown in FIG. 1.

In the copying machine 100, 901 is a central processing unit (CPU) for the copying machine, which effects control with a variety of motors within the copying machine, or the monitor with the sensor, the copy sequence processing, and the serial communication with the CPU 801 of the copying machine administrating apparatus. Reference numeral 902 is a static RAM (SRAM) for storing the status of the copying machine. Reference numeral 903 is a dynamic RAM (DRAM) which is usable for the work area of program. Reference numeral 904 is a ROM for storing the copy sequence program. Reference numeral 905 is a bus line for connecting the CPU 901 to SRAM 902, DRAM 903 and ROM 904 via the bus. Reference numeral 906 is an I/O or I/F for the motor or sensor.

In the copying machine administrating apparatus 800, 801 is a central processing unit (CPU) of the copying machine administrating apparatus, which effects control for a variety of input/output devices such as card reader 500, the sequence processing such as setting the upper limit sheet number for each department or tabulation for each department, and the serial communication with the CPU 901.

Reference numeral 802 is a SRAM for storing the copy sheet number and the upper limit sheet number for each department. Reference numeral 803 is a DRAM which is usable for the work area of program. Reference numeral 804 is a ROM for storing the sequence process program. Reference numeral 808 is a bus line for connecting the CPU 801 to SRAM 802, DRAM 803 and ROM 804 via the bus.

Reference numeral 500 is a card reader for reading a magnetic card storing the department number and passing the department number to the CPU 801. Reference numeral 805 is a printer I/F which is an interface for the connection of a printer for the tabulation. Reference numeral 806 is a key & display I/F which is an interface for connecting a dedicated key & display for use in setting the upper limit sheet number, setting the disabled department, and the tabulation. Reference numeral 807 is a computer I/F which is an interface with a host computer 1100 via a RS-232C cable 1110. The host computer 1100 receives the count data as hereinafter described from the copying machine administrating apparatus 800 at appropriate times, and manages the service amount of the copying machine 100 or makes the maintenance of the copying machine 100 based on the count data. It is noted that the RS-232C cable 1110 may be replaced with the public line, or the computer I/F 807 replaced with a modem. The host computer 1100 may be installed at a service center in the remote site, or in an administrating chamber within the premises. The CPU 801 receives the status information from the CPU 901 via the serial line 1000, and updates the use information of the copying machine which has been stored in SRAM 802 in accordance with the pulse signal on a line 1002 which is output from the CPU 901. Thereby, if the status of the copying machine 1000 is changed, the copying machine administrating apparatus 800 is informed of the status information of copying machine, whereby the update information can be notified to the copying machine administrating apparatus side with a pulse signal in correspondence to its status.

Also, the CPU 801 receives the changed status information which is transferred via the serial line 1000, and updates the use information of the copying machine 100 which has been stored in SRAM 802 in accordance with a pulse signal output from the CPU 901.

Further, the CPU 801 updates the use information of the copying machine which has been stored in SRAM 802, based on the status information to be transferred via the serial line 1000 and the copying conditions to be set.

Also, the copying machine 100 notifies the changed status information to the copying machine administrating apparatus 800 if an original of different size is fed from the RDF 300.

Further, via the serial line 1000, the CPU 901 transfers the status information to the copying machine administrating apparatus 800 at the time when the setting of the copy mode is changed.

Also, the CPU 901 updates the copy sheet number which is stored, based on the status information received.

Note that accumulating the copy sheet number for each department, setting the upper limit sheet number for each department and setting the disabled department are made on a personal computer, not shown. Reference numerals 1000, 1001 are serial communication lines for the connection from a transmission terminal of the CPU 901 to a reception terminal of the CPU 801, and from a transmission terminal of the CPU 801 to a reception terminal of the CPU 901, respectively. The serial line 1000 is employed to send the status information from the copying machine 100 to the copying machine administrating apparatus 800, for example, the mode information which has been set on the operation panel of the copying machine 100 as the status information is sent from the CPU 901 via the serial line 1000 to the CPU 801. In addition, other status information includes a result of each sensor.

Also, the serial line 1001 is employed to send a command from the copying machine administrating apparatus 800 to the copying machine 100, for example, a command for enabling or disenabling the copying machine 100 in accordance with the card inserted into the card reader of the copying machine administrating apparatus. Reference numeral 1002 is a count pulse line which is a line for sending the pulse from a port of the CPU 901 to a port of the CPU 801, every time the copying machine 100 exhausts the transfer sheet copied therefrom.

Referring now to a timing chart of FIG. 4, a first copy mode sheet number administrating operation in a copying system according to the invention will be described below.

Figure 4:
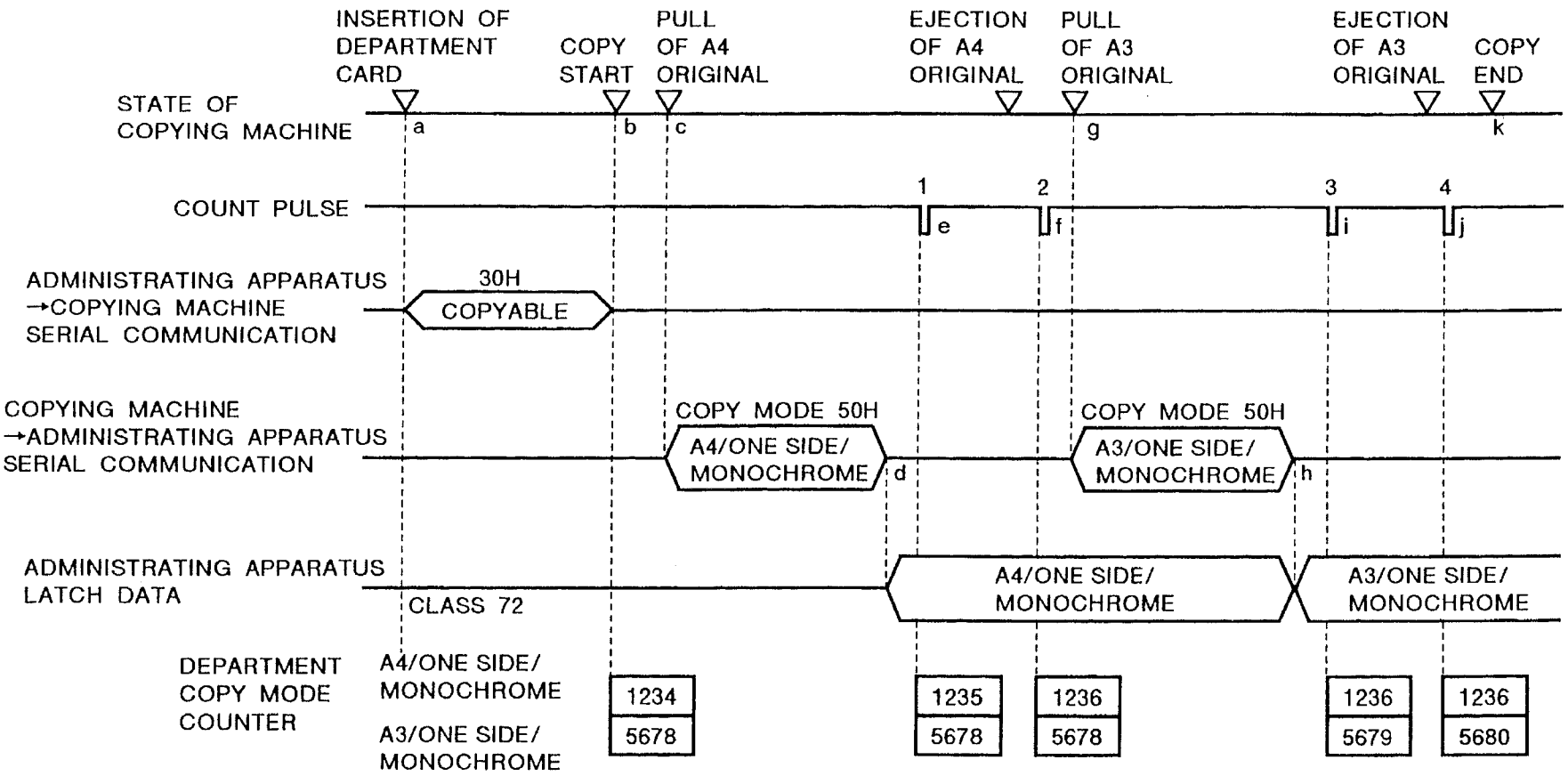
FIG. 4 is a timing chart for explaining a first copy mode sheet number administrating operation in a copying system.

FIG. 4 is a timing chart for explaining the first copy mode sheet number administrating operation in the copying system according to the present invention. Note that a cyclic automatic original feeder RDF 300 is used in this operation.

An uppermost chart as shown in FIG. 4 represents the state of the copying machine. A second chart is a count pulse which is a pulse to be sent from the copying machine 100 to the copying machine administrating apparatus 800 via the line 1002 every time the transfer sheet is copied and exhausted therefrom.

A third chart represents the content of data to be sent from the copying machine administrating apparatus 800 to the copying machine 100 via the line 1001. In FIG. 4, upon insertion of a normal department card into the card reader 500 of the copying machine administrating apparatus 800, a command for activating the copying machine 100 to be copyable is sent to the copying machine 100.

A fourth chart represents the content of data to be sent from the copying machine 100 to the copying machine administrating apparatus 800 via the line 1000.

Data sent on the line 1000 includes the size of the transfer sheet used in copying, and the copy mode such as one-side copy or both-side copy, or monochrome copy or full-color copy.

A fifth chart represents the copy mode to be latched in SRAM 802 for the copying machine administrating apparatus 800. The CPU 801 of the copying machine administrating apparatus 800 latches the copy mode received in the serial communication into SRAM 802, and upon receiving the count pulse on the line 1000, adds to a counter corresponding to a respective mode by referring to this latch data.

A sixth chart represents the sheet number counters for "A4/one-side/monochrome" copy mode with a department number 72, and "A3/one-side/monochrome" copy mode, wherein a sheet number counter for each department and each copy mode is stored in SRAM 802 of the copying machine administrating apparatus 800, and particularly in an example of FIG. 4, with one A4 original and one A3 original laid on the RDF 300, the user of department number 72 is making two copies, using a black developer, under the conditions of direct, one-side.

Note that the interval ratio of the time axis in the timing charts of FIG. 4 and FIGS. 5 and 6, as will be described later, is different from the practical time interval ratio.

First, at time a in FIG. 4, the user having a department card indicating the department number 72 inserts a card into the card reader 500. Accordingly, the copying machine administrating apparatus 800 sends a copy operation enable command "30H" to the copying machine 100 via the line 1001, and the copying machine 100 is enabled for the copy operation, upon receiving the command "30H". At time b, if the user depresses a copy start button, the copying machine 100 starts the copy operation. Then, the copying machine 100 sends a copy mode which has been set by the user to the copying machine administrating apparatus 800.

Herein, this copy mode is a mode of copying on the transfer sheet of the size identical to that of the original laid on the RDF 300, whereby the original size can be sensed during conveying of the original, and the original size can be determined at time c when the original is conveyed on to the platen glass 101. Therefore, the copy mode can be sent at time c when the original is pulled in.

In the serial communication of bit-by-bit transmission, a command "50H" which signifies that the copy mode is sent at the first one byte, the size of transfer sheet at the second byte, and data indicating one-side or both-side and monochrome or full-color at the third byte are sent. That is, as the set copy mode is A4, one-side mode, and monochrome copy, "50H/A4/one-side/monochrome" is sent in sequence, supposing that "/" indicates a delimiter of one byte (the same symbol used hereinafter).

At time d, if the copying machine administrating apparatus 800 has received the copy mode, the copy mode received is latched into SRAM 802.

At time e, if one count pulse is received, the sheet number counter for "A4/one-side/monochrome" of the department (department number 72) in use, which is already formatted on the SRAM 802, is incremented by one (1234→1235), as it is construed that one transfer sheet has been ejected in the copy mode "A4/one-side/monochrome" latched.

Similarly, at time f, if one count pulse is received, the sheet number counter for "A4/one-side/monochrome" is incremented by one (1235→1236), as it is construed that one transfer sheet has been ejected in the copy mode "A4/one-side/monochrome" latched.

Next, at time g, as the RDF 300 pulls the original into the platen glass 101, the copy mode "A3/one-side/monochrome" is sent in the order of (50H/A3/one-side/monochrome).

At time h, if the copying machine administrating apparatus 800 has received the copy mode, the copy mode received is latched into SRAM 802. At time i, if one count pulse is received, the sheet number counter for "A3/one-side/monochrome" of the department in use, which is already formatted on the SRAM 802, is incremented by one (5678→5679), as it is construed that one transfer sheet has been ejected in the copy mode "A3/one-side/monochrome" latched.

Similarly, at time j, if one count pulse is received, the sheet number counter for "A3/one-side/monochrome" is incremented by one (5679→5680), as it is construed that one transfer sheet has been ejected in the copy mode "A3/one-side/monochrome" latched. At time k, the copying machine 100 terminates the copying operation.

[Second Example]

Referring now to a timing chart of FIG. 5, a second copy mode sheet number management operation in a copying system according to the present invention will be described below.

Figure 5:
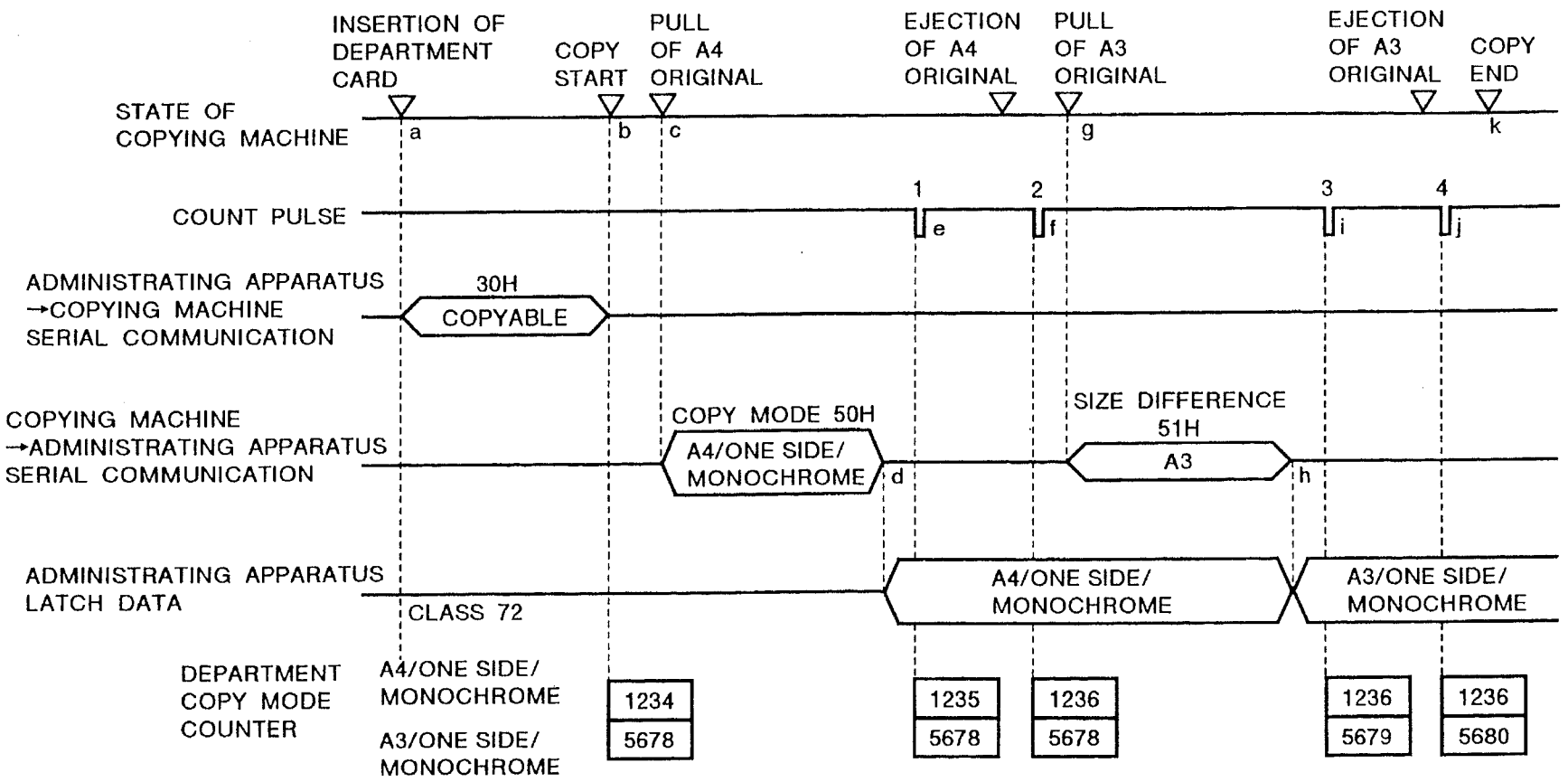
FIG. 5 is a timing chart for explaining a second copy mode sheet number administrating operation in a copying system.

FIG. 5 is a timing chart for explaining the second copy mode sheet number management operation in the copying system according to the invention. Note that this operation also uses a cyclic automatic original feeder RDF 300. A different point from the first example is that the copy mode other than initially sent copy mode after the start of the copy job, that is, the copy mode to be sent at the second time and beyond, involves sending the information concerning the difference from the previously sent copy mode, that is, the information different from the previous copy mode.

In an example of FIG. 5, with one A4 original and one A3 original laid on the RDF 300, the user of department number 72 is making two copies, using a black developer, under the conditions of direct, one-side.

Referring to FIG. 5, there will be described only different processings from those of FIG. 4. The processings up to time f are the same as in FIG. 4.

At time g, the RDF 300 pulls the A3 original on to the platen glass 101, wherein the copy mode is "A3/one-side/monochrome". That is, as the difference from the previous copy mode "A4/one-side/monochrome" is only the size of "A3", it is notified that the difference from the previous mode is A3 size, using a command for sending the difference information of the transfer sheet size. In sending the difference information of the transfer sheet size, a command which signifies that the transfer sheet size is sent as the difference information at the first one byte, e.g., "51H", and the size of the transfer sheet at the second byte is sent.

That is, the information is sent in the order of "51H/A3". At time h, if the copying machine administrating apparatus 800 has received the command, the copy mode is latched by rewriting a portion of A4 in the previous copy mode "A4/one-side/monochrome" with A3. The processings following time i are the same as in FIG. 4.

[Third Example]

While in the first and second examples as above described, the copy mode sheet number administrating processing operation using the count pulse communication and the serial communication has been described, it will be appreciated that the copy mode sheet number administration may be performed only with the serial communication and without the count pulse communication.

Referring now to a timing chart of FIG. 6, a third copy mode sheet number administrating operation in a copying system according to the invention will be described below.

Figure 6:
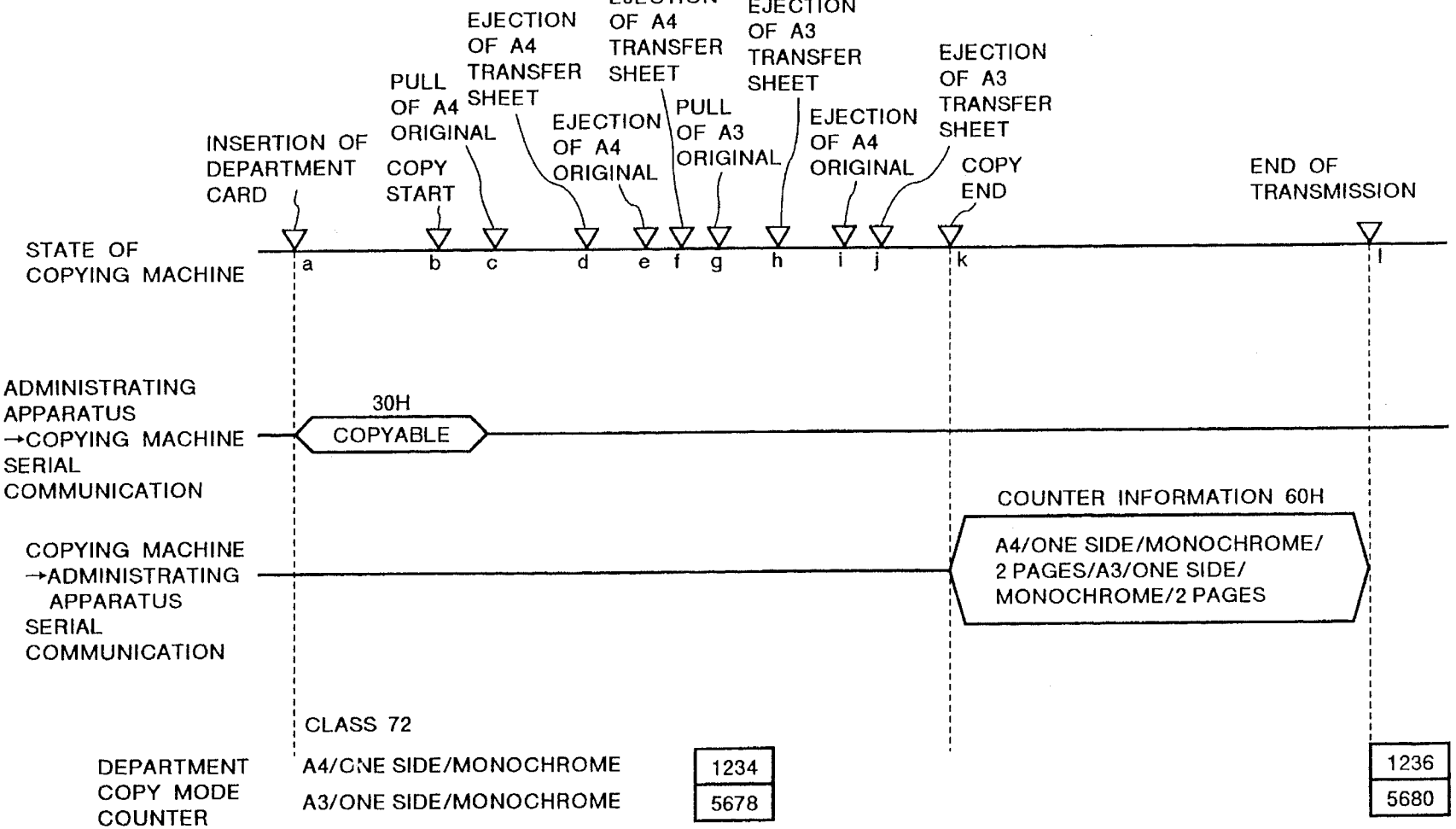
FIG. 6 is a timing chart for explaining a third copy mode sheet number administrating operation in a copying system.

FIG. 6 is a timing chart for explaining the third copy mode sheet number administrating operation in the copying system according to the present invention. Note that a cyclic automatic original feeder RDF 300 is used in this operation.

In FIG. 6, a first chart represents the state of copying machine. A second chart represents the content to be sent from the copying machine administrating apparatus 800 to the copying machine 100 via the line 1001.

In FIG. 6, upon insertion of a normal department card into the card reader 500 of the copying machine administrating apparatus 800, a command for activating the copying machine 100 to be copyable is sent to the copying machine 100. A third chart represents the content to be sent from the copying machine 100 to the copying machine administrating apparatus 800 via the line 1000.

In FIG. 6, when the copy job is ended, the copy mode of the copying job and the corresponding copy sheet number are sent.

A fourth chart represents the sheet number counters for the copy mode "A4/one-side/monochrome" of department number 72 and the copy mode "A3/one-side/monochrome", wherein a sheet number counter for each department and each copy mode is already formatted on the SRAM 802 of the copying machine administrating apparatus 800.

In an example of FIG. 6, with one A4 original and one A3 original laid on the RDF 300, the user of department number 72 is making two copies, using a black developer, under the conditions of direct, one-side.

First, at time a, the user having a department card indicating the department number 72 inserts a card into the card reader 500. Then, the copying machine administrating apparatus 800 sends a copy operation enable command "30H" to the copying machine 100 via the line 1001. The copying machine 100 is enabled for the copy operation, upon receiving the command "30H". At time b, if the user depresses a copy start button, the copying machine 100 starts the copy operation.

At time c, the RDF 300 pulls in the A4 original laid, and at time d and time f, the copying machine 100 ejects the A4 transfer sheet.

Also, at time e, the RDF 300 ejects the A4 original, and at time g, it pulls in the A3 original laid next.

And at time h and time j, the copying machine 100 ejects the A3 transfer sheet. Also, the A3 original is ejected at time i. At time k, the copying machine 100 ends the copying operation, whereby the counter information is serially communicated. In this example, two sheets in "A4/one-side/monochrome" mode and two sheets in "A3/one-side/monochrome" have been copied, wherein "60H/A3/one-side/monochrome/A4/one-side/monochrome" and terminal symbol is sent in sequence, seeing that a command for sending the counter information is 60H, for example. At time 1, as the sending of this command is ended, the copying machine administrating apparatus 800 increments by two the counter of "A4/one-side/monochrome" and the counter of "A3/one-side/monochrome", respectively.

In this way, since the copy mode sheet number administration is performed through the serial communication and the count pulse communication, it is unnecessary to wire the signal lines corresponding to the number of bits for the amount of information in the copy mode between the copying machine 100 and the copying machine administrating apparatus 800 as was conventionally performed, whereby for example, by directly using the serial communication interface which already exists in the CPU, the saving of both CPU boards can be effected, resulting in significant reduction in the hardware cost and the labor.

Since the copy mode is sent from the copying machine 100 to the copying machine administrating apparatus 800 when the copying operation is started and when the copy mode is changed during the copying operation, the frequency of the serial communication can be reduced to the minimum.

In addition, when the copy mode is changed during the operation, the loads of the copying machine 100 and the copying machine administrating apparatus 800 can be lowered by communicating the difference information from the previously sent copy mode.

Also, the serial communication singly can perform the copy mode sheet number administration.

Also, the copy mode used in the copying job and the copy sheet number for respective copy mode can be collectively sent in serial communication from the copying machine to the copying machine administrating apparatus, for example, after the end of copying operation, whereby when the processing occupancy ratio of the copying machine is relatively high, such as during the operation of copying machine, the serial communication can be avoided.

What is claimed is:

1. An administrating apparatus for administrating an image forming apparatus, comprising:

first receiving means for receiving status information of said image forming apparatus, said first receiving means receiving updated status information in accordance with changes in a status of said image forming apparatus;

second receiving means for receiving a pulse signal in accordance with operation of said image forming apparatus; and count means for counting in accordance with the status information received by said first receiving means and the pulse signal received by said second receiving means, said count means counting for each status indicated by the status information.

2. An administrating apparatus according to claim 1, further comprising transmitting means for transmitting a count result of said count means to a computer apparatus.

3. An administrating apparatus according to claim 1, wherein the status information contains a size a sheet on which said image forming apparatus forms an image.

4. An administrating apparatus according to claim 1, wherein the status information includes a mode of said image forming apparatus.

5. An administrating apparatus according to claim 1, wherein the pulse signal is output singly every time said image forming apparatus operates once.

6. An administrating apparatus according to claim 1, wherein said first receiving means receives a serial communication.

7. An administrating apparatus for administrating an image forming apparatus, comprising:

first receiving means for receiving status information of said image forming apparatus;

second receiving means for receiving a pulse signal in accordance with the operation of said image forming apparatus; and count means for counting in accordance with the status information received by said first receiving means and the pulse signal received by said second receiving means, said first receiving means receiving only updated status information every time the status of said image forming apparatus is changed.

8. An administrating method for administrating an image forming apparatus, comprising the steps of:

receiving status information of the image forming apparatus, said receiving step including receiving updated status information in accordance with changes in a status of the image forming apparatus;

receiving a pulse signal in accordance with operation of the image forming apparatus; and counting in accordance with the status information received and the pulse signal received, said counting step including counting for each status indicated by the status information.

9. An administrating method according to claim 8, further comprising transmitting a count result to a computer apparatus.

10. An administrating method according to claim 8, wherein the status information contains a size of a sheet on which the image forming apparatus forms an image.

11. An administrating method according to claim 8, wherein the status information includes a mode of the image forming apparatus.

12. An administrating method according to claim 8, wherein said status information receiving step includes receiving status information every time the status of the image forming apparatus is changed.

13. An administrating method according to claim 8, wherein the pulse signal is output singly every time the image forming apparatus operates once.

14. An administrating method according to claim 8, wherein the status information receiving step includes receiving a serial communication.

15. An administrating method for administrating an image forming apparatus, comprising the steps of:

receiving the status information of said image forming apparatus;

receiving a pulse signal in accordance with the operation of said image forming apparatus; and counting in accordance with the status information received and the pulse signal received, said status information receiving step including receiving only updated status information every time the status of said image forming apparatus is changed.

16. An administrating method for administrating an image forming apparatus, comprising the steps of:

receiving status information of the image forming apparatus and operation number information of the image forming apparatus for each status;

storing accumulating total information of the operation number for each status of the image forming apparatus; and updating the accumulating total information stored in accordance with the status information and the operation number information at said receiving step.

17. An administrating method according to claim 16, further including sending the accumulating total information stored to a computer apparatus.

18. An administrating method according to claim 16, wherein the status information contains a size of a sheet on which the image forming apparatus forms an image.

19. An administrating method according to claim 16, wherein the status information includes a mode of the image forming apparatus.

20. An administrating method according to claim 16, wherein said receiving step includes receiving a serial communication.

* * * * *

UNITED STATES PATENT AND TRADEMARK OFFICE

CERTIFICATE OF CORRECTION

PATENT NO. : 5,561,501

DATED : October 1, 1996

INVENTOR(S) : MASAYUKI HONMA

It is certified that error appears in the above-indentified patent and that said Letters Patent is hereby corrected as shown below:

COLUMN 9:

Line 35, "size" should read --size of--.

Signed and Sealed this

First Day of April, 1997

Bruce Lehman

BRUCE LEHMAN

*Commissioner of Patents and Trademarks*

*Attest:*

*Attesting Officer*